US011359590B1

(12) United States Patent
John et al.

(10) Patent No.: US 11,359,590 B1
(45) Date of Patent: Jun. 14, 2022

(54) IGNITER FOR DUAL FUEL ENGINE HAVING LIQUID FUEL OUTLET CHECKS AND SPARK IGNITION SOURCE

(71) Applicant: Caterpillar Inc., Peoria, IL (US)

(72) Inventors: Bobby John, Peoria, IL (US); Jonathan William Anders, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/330,786

(22) Filed: May 26, 2021

(51) Int. Cl.

| | |
|---|---|
| ***F02M 57/06*** | (2006.01) |
| ***F02F 3/26*** | (2006.01) |
| ***F02M 61/18*** | (2006.01) |
| ***F02D 41/40*** | (2006.01) |
| ***F02M 25/00*** | (2006.01) |

(52) U.S. Cl.
CPC ..... *F02M 57/06* (2013.01); *F02D 41/403* (2013.01); *F02F 3/26* (2013.01); *F02M 25/00* (2013.01); *F02M 61/1806* (2013.01)

(58) Field of Classification Search
CPC .... F02M 57/06; F02M 25/00; F02M 61/1806; F02F 3/26; F02D 41/403
USPC ..... 123/297, 298, 299, 300, 525, 25 C
See application file for complete search history.

(56) References Cited

U.S. PATENT DOCUMENTS 3,507,262 A * 4/1970 Stage ..... F02M 55/02 123/504
4,892,070 A * 1/1990 Kuhnert ..... H01T 13/54 123/274
5,293,851 A * 3/1994 Schaub ..... F02B 19/14 123/259
5,609,130 A * 3/1997 Neumann ..... F02B 19/1004 123/267
5,715,788 A 2/1998 Tarr et al.
5,983,855 A 11/1999 Benedikt et al.
6,032,617 A 3/2000 Willi et al.
6,276,334 B1 8/2001 Flynn et al.
6,505,601 B1 1/2003 Jorach et al.
6,513,483 B2 * 2/2003 Riggs ..... F02B 19/16 123/254

(Continued)

FOREIGN PATENT DOCUMENTS

DE 102006014071 B3 10/2007
DE 102006029210 A1 12/2007

(Continued)

OTHER PUBLICATIONS

Dawn Hibbard, "Improving Diesel Engine Performance", Kettering University News, Jul. 28, 2011.

(Continued)

*Primary Examiner* — Hai H Huynh
(74) *Attorney, Agent, or Firm* — Brannon Sowers & Cracraft

(57) ABSTRACT

An igniter for a dual fuel engine includes an igniter body having spray outlets formed in a nozzle and arranged in a plurality of outlet sets. The igniter further includes a plurality of outlet checks each movable in the igniter body to open and close the spray outlets in a respective one of the plurality of outlet sets, and spark electrodes mounted to the igniter body and forming a spark gap. The outlet sets vary set-to-set in at least one of spray angle, spray outlet number, or spray outlet size. Related methodology is disclosed.

20 Claims, 3 Drawing Sheets

(56) References Cited

U.S. PATENT DOCUMENTS

| | | | | |
|---|---|---|---|---|
| 6,536,405 | B1 | 3/2003 | Rieger et al. | |
| 6,561,157 | B2 | 5/2003 | zur Loye et al. | |
| 6,640,773 | B2 | 11/2003 | Ancimer et al. | |
| 6,659,071 | B2 | 12/2003 | LaPointe et al. | |
| 6,843,220 | B2 * | 1/2005 | Lausch | F02B 19/14 123/261 |
| 6,907,870 | B2 | 6/2005 | Zur Loye et al. | |
| 6,912,992 | B2 | 7/2005 | Ancimer et al. | |
| 6,915,776 | B2 | 7/2005 | zur Loye et al. | |
| 7,007,669 | B1 | 3/2006 | Willi et al. | |
| 7,574,993 | B2 | 8/2009 | Gillespie et al. | |
| 7,841,308 | B1 | 11/2010 | Muth | |
| 7,950,364 | B2 * | 5/2011 | Nerheim | F02B 19/1014 123/259 |
| 8,327,823 | B2 | 12/2012 | Courtoy et al. | |
| 8,555,852 | B2 | 10/2013 | Munshi et al. | |
| 8,925,518 | B1 | 1/2015 | Riley et al. | |
| 9,353,674 | B2 * | 5/2016 | Bunce | F02B 19/12 |
| 9,856,835 | B1 | 1/2018 | Coldren et al. | |
| 9,890,689 | B2 | 2/2018 | Hampson et al. | |
| 10,273,894 | B2 | 4/2019 | Tripathi | |
| 10,598,079 | B2 * | 3/2020 | Anderson | F02B 19/00 |
| 10,690,107 | B1 | 6/2020 | Anders et al. | |
| 11,060,443 | B1 * | 7/2021 | Thomas | F02M 61/14 |
| 11,143,091 | B2 * | 10/2021 | Wei | F02F 1/242 |
| 2002/0134347 | A1 * | 9/2002 | Artioli | F02M 67/02 123/297 |
| 2004/0112328 | A1 * | 6/2004 | Herden | F02M 61/14 123/297 |
| 2004/0149256 | A1 * | 8/2004 | Dye | F02M 57/00 123/297 |
| 2005/0120995 | A1 | 6/2005 | Tsujimoto et al. | |
| 2006/0169244 | A1 | 8/2006 | Allen | |
| 2008/0072871 | A1 | 3/2008 | Vogel et al. | |
| 2013/0146037 | A1 | 6/2013 | Han et al. | |
| 2014/0373807 | A1 * | 12/2014 | Repelli | F02D 41/0027 123/297 |
| 2015/0285178 | A1 | 10/2015 | John | |
| 2016/0177851 | A1 | 6/2016 | Gruber et al. | |
| 2016/0195051 | A1 * | 7/2016 | Konczol | F02B 19/1014 123/297 |
| 2017/0241325 | A1 | 8/2017 | Gu et al. | |

FOREIGN PATENT DOCUMENTS

| | | | |
|---|---|---|---|
| JP | 2008255837 | A | 10/2008 |
| KR | 20100006893 | U | 7/2010 |
| WO | 2012010237 | A1 | 1/2012 |

OTHER PUBLICATIONS

Amin Paykani, "Progress and Recent Trends in Reactivity-controlled Compression Ignition Engines", International Journal of Engine Research, Jul. 2015.

* cited by examiner

IGNITER FOR DUAL FUEL ENGINE HAVING LIQUID FUEL OUTLET CHECKS AND SPARK IGNITION SOURCE

TECHNICAL FIELD

The present disclosure relates generally to an igniter for a dual fuel engine, and more particularly to an igniter having both spark electrodes forming a spark gap and a plurality of liquid fuel outlet checks.

BACKGROUND

Internal combustion engines are widely used throughout the world for vehicle propulsion, electric power generation, handling of liquids and gases, and in various industrial applications. Fuel and air is combusted within an engine cylinder in a conventional operating scheme to produce a rapid rise in pressure that drives a piston coupled with a crankshaft. Spark-ignited engines typically employ a liquid petroleum distillate fuel such as gasoline, or a gaseous fuel such as natural gas, methane, propane, mixtures of these, and various others. Compression-ignition engines utilize fuels such as diesel distillate fuel, biodiesel, and others that can be autoignited with air in a compression stroke of a piston. Research interest in recent years has increasingly gravitated toward flexibility of engines with regard to fuel utilization, especially utilization of gaseous fuels.

Fuel prices are often dynamic, and certain gaseous fuels can have combustion or emissions characteristics which it is desirable to exploit. Certain engines allow for operation on both or either of a liquid fuels and a gaseous fuel. Diesel alone is relatively easy to autoignite but can have undesirable emissions. Natural gas, on the other hand, in some instances can exhibit ignition problems such as ignition failure or knock, or suffer from problems of combustion stability. In so called lean-burn applications, where gaseous fuel and air are burned at a stoichiometrically lean equivalence ratio, such challenges can be particularly acute.

Dual fuel engines where a combustion-initiating pilot injection of liquid fuel is used to ignite a main charge of gaseous fuel address some of these issues with combustion predictability and controllability. In still other proposed dual fuel engines, a spark plug can be used to ignite the main charge of gaseous fuel, with liquid fuel injection used when operating in a diesel-only mode. Each of these general approaches suffer from a variety of drawbacks, but have certain advantages. Packaging concerns where both a fuel injector and a spark plug are used in the same engine exist, as well as potentially increased costs with an increased number of parts. One example of a dual fuel engine employing an igniter configured for liquid pilot fuel injection and spark ignition is known from commonly owned U.S. Pat. No. 10,690,107 to Anders et al.

SUMMARY

In one aspect, an igniter for a dual fuel engine includes an igniter body defining an igniter center axis extending between a first igniter body end and a second igniter body end including a nozzle. The igniter body further includes formed therein a fuel inlet, spray outlets formed in the nozzle and arranged in a plurality of outlet sets, and at least one nozzle supply passage extending between the fuel inlet and the spray outlets. The igniter further includes a plurality of outlet checks each movable in the igniter body to open and close the spray outlets in a respective one of the plurality of outlet sets, and spark electrodes mounted to the second igniter body end and forming a spark gap.

In another aspect, a dual fuel engine system includes an engine housing having a combustion cylinder formed therein, and a piston movable between a bottom-dead-center position and a top-dead-center position in the combustion cylinder. The engine system further includes an igniter having spark electrodes forming a spark gap within the combustion cylinder, a nozzle having spray outlets formed therein and arranged in a plurality of outlet sets, and a plurality of outlet checks each movable to open and close the spray outlets in a respective one of the plurality of outlet sets.

In still another aspect, a method of operating a dual fuel engine system includes conveying a main charge of gaseous fuel into a combustion cylinder in an engine housing, and moving a piston from a bottom-dead-center position to a top-dead-center position in the combustion cylinder to increase a pressure of a mixture of the main charge of gaseous fuel and air. The method further includes lifting some but less than all of a plurality of checks in an igniter extending into the combustion cylinder, and injecting a pilot charge of liquid fuel into the combustion cylinder from spray outlets in the igniter opened by way of the lifting of some but less than all of a plurality of checks. The method still further includes producing an electrical spark at a spark gap formed by spark electrodes of the igniter, and combusting the main charge of gaseous fuel based on combustion of the pilot charge of liquid fuel and the electrical spark.

DETAILED DESCRIPTION

Figure 1:
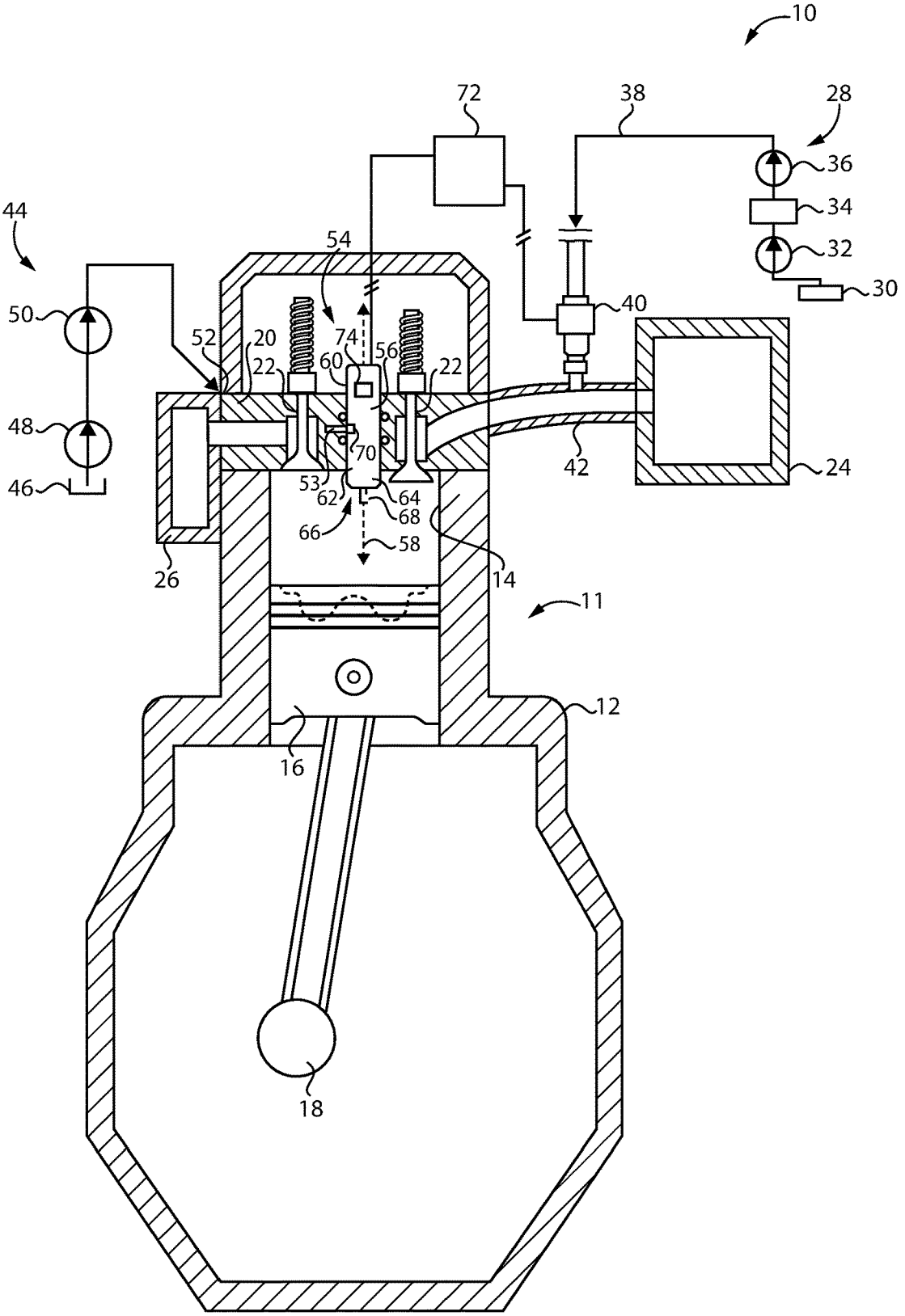
FIG. 1 is a sectioned side diagrammatic view of a dual fuel engine system, according to one embodiment.

Referring to FIG. 1, there is shown a dual fuel engine system 10 including a dual fuel engine 11, according to one embodiment. Engine 11 includes an engine housing 12 having one or more combustion cylinders 14 formed therein. A piston 16 is movable in combustion cylinder 14 between a bottom-dead-center (BDC) position and a top-dead-center (TDC) position in combustion cylinder 14 to increase a pressure of a mixture of a main charge of gaseous fuel and air in combustion cylinder 14, typically in a four-stroke engine cycle as further discussed herein. Piston 16 is coupled with a crankshaft 18 to rotate crankshaft 18 for purposes such as vehicle propulsion, operation of a compressor or a pump, or production of electrical power using an associated electrical generator, to name a few examples. Combustion cylinder 14 may be one of any number of combustion cylinders arranged in any suitable configuration such as an inline pattern, a V-pattern, or still another. Engine 11 further includes an engine head 20 attached to engine housing 12. Engine valves 22 including one or more exhaust valves and one or more intake valves are supported in engine head 20 and movable to control fluid communications between combustion cylinder 14 and an intake manifold 24 and an exhaust manifold 26.

Engine system 10 further includes a gaseous fuel system 28. Gaseous fuel system 28 includes a gaseous fuel supply 30 containing, for example, a cryogenically stored liquified gaseous fuel or a pressurized gaseous fuel, a transfer pump 32, a vaporizer 34, and a pressurization pump 36. A gaseous fuel conduit 38 extends from pump 36 to an electrically actuated gaseous fuel admission valve 40 coupled to an intake runner 42. Intake runner 42 connects between intake manifold 24 and combustion cylinder 14, thus admission valve 40 is fluidly between fuel supply 30 and combustion cylinder 14. Those skilled in the art will recognize engine system 10 may be port-injected with gaseous fuel. In other embodiments engine system 10 could be direct-injected with gaseous fuel, fumigated with gaseous fuel, or gaseous fuel could be delivered into intake manifold 24, for example. A plurality of additional intake runners (not shown) can extend to other combustion cylinders in engine system 10. Suitable gaseous fuels according to the present disclosure can include natural gas, methane, ethane, propane, landfill gas, biogas, premixed gasoline, mixtures of these, or still others.

Engine system 10 also includes a liquid fuel system 44. Suitable liquid fuels in the present context can include a diesel distillate fuel, JP8, or a variety of other suitable liquid fuels having a cetane number, or including a cetane enhancer, sufficient for compression ignition according to conventional practices. Liquid fuel system 44 includes a liquid fuel supply or fuel tank 46, a low pressure transfer pump 48, and a high pressure pump 50. A fuel inlet 52 feeds a supply of liquid fuel to a fuel conduit 53 supplying the liquid fuel to an igniter 54. Thus, liquid fuel supply or fuel tank 46 is fluidly connected to igniter 54. Fuel inlet 52 could be an inlet to engine head 20 or to a fuel reservoir external to engine head 20, for example. Pressurization of liquid fuel for injection could occur using a pump that maintains (and adjusts pressure of) a pressurized fuel reservoir such as a common rail for delivery to a plurality of igniters in engine system 10. Alternatively, so-called unit pumps could be associated directly with one or more, but less than all, of a plurality of igniters in engine system 10.

Figure 2:
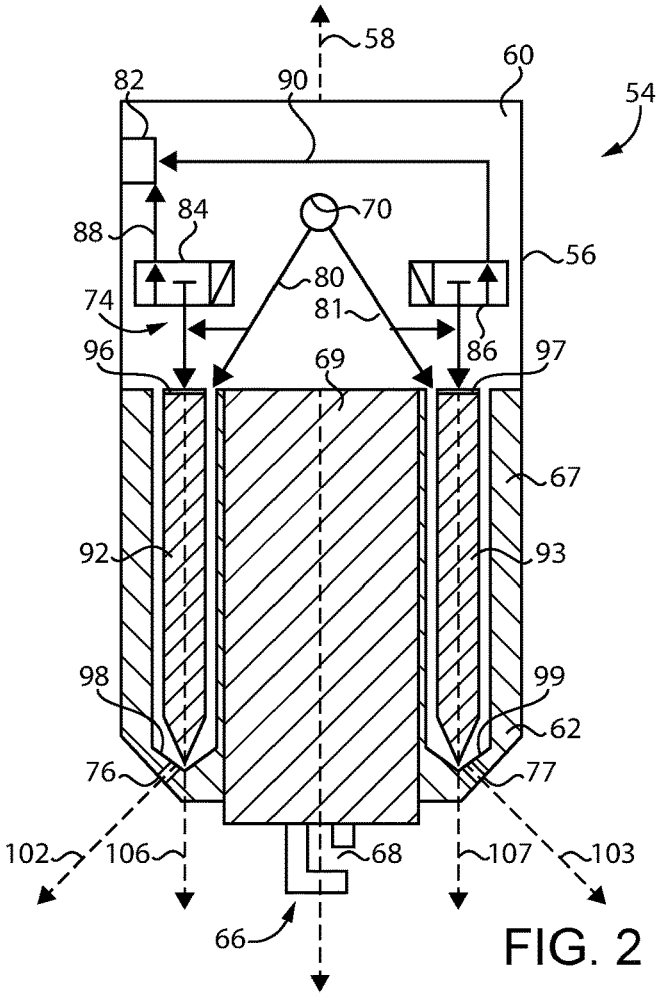
FIG. 2 is a diagrammatic view of an igniter for a dual fuel engine, according to one embodiment.
Figure 3:
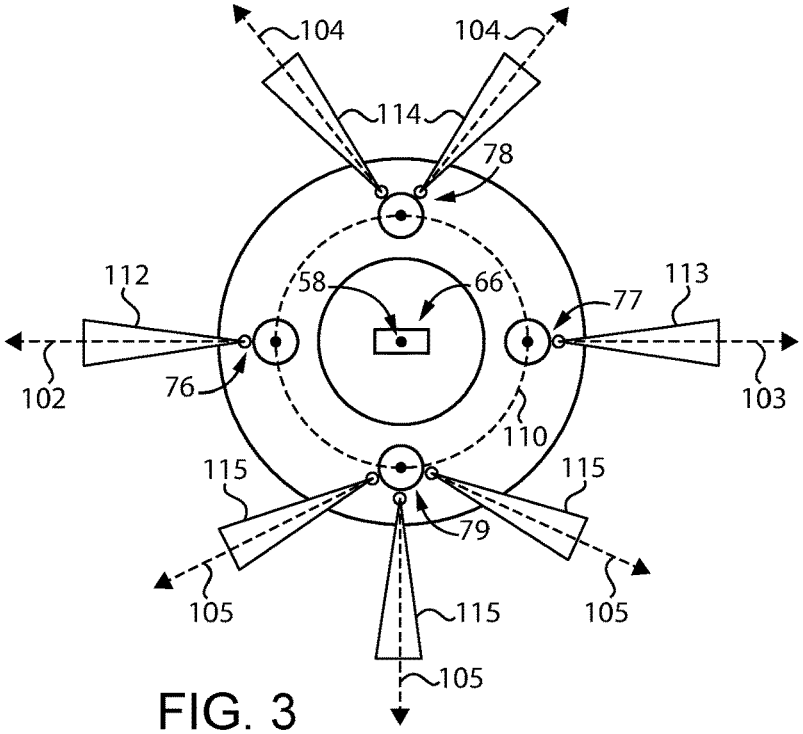
FIG. 3 is an end view of the igniter of FIG. 2.

Referring also now to FIGS. 2 and 3, igniter 54 includes an igniter body 56 extending into combustion cylinder 14 and defining an igniter center axis 58 extending between a first igniter body end 60 and a second igniter body end 62 including a nozzle 64. Igniter 54 further includes spark electrodes 66 mounted to second igniter body end 62 and forming a spark gap 68 within combustion cylinder 14. Spark electrodes 66 could be encapsulated, or non-encapsulated, and could include a J-gap arrangement or any other suitable geometric configuration. In the illustrated embodiment, igniter 54 includes an outer housing 67 of igniter body 56, and a plug body 69 within outer housing 67, with spark electrodes 66 supported in plug body 69. Engine system 10 also includes an electronic control unit 72, including any suitable computerized control unit. Electronic control unit 72 is electrically connected to igniter 54 to energize spark electrodes 66 so as to form an electrical spark at spark gap 68. Electronic control unit 72 may also be electrically connected to admission valve 40, and to an electrically actuated control valve assembly 74 resident in igniter body 56.

Igniter body 56 further has formed therein a fuel inlet 70, and spray outlets formed in nozzle 64 and arranged in a plurality of outlet sets 76, 77, 78, and 79. Igniter body 56 further includes at least one nozzle supply passage extending between fuel inlet 70 and all of the spray outlets 76, 77, 78, and 79. In the illustrated embodiment, and with focus on FIG. 2, there can be seen a first nozzle supply passage 80 and a second nozzle supply passage 81. It will be understood that additional nozzle supply passages not visible in the sectioned view may be provided. Igniter 54 also includes a plurality of outlet checks 92, 93, 94, and 95 each movable in igniter body 56 to open and close spray outlets in a respective one of the plurality of outlet sets 76, 77, 78, and 79, and positioned fluidly between fuel tank 46 and a respective one of the plurality of outlet sets 76, 77, 78, and 79. As can also be seen from FIG. 2, a first valve seat 98 is formed in nozzle 64 and opened and closed by way of outlet check 92. A second valve seat 99 is formed in nozzle 64 and opened and closed by outlet check 93.

It will be recalled igniter 54 may include a control valve assembly 74. With continued focus on FIG. 2, control valve assembly 74 may include a first electrically actuated control valve 84 and a second electrically actuated control valve 86 operable to open and close outlet check 92 and outlet check 93, respectively. Outlet check 92 includes a closing hydraulic surface 96. Outlet check 93 includes a closing hydraulic surface 97. Outlet checks 92 and 93 can thus be understood as directly-controlled. The other outlet checks 94 and 95 will typically be associated each with one electrically actuated control valve and also having closing hydraulic surfaces analogous to that shown in connection with outlet check 92 and outlet check 93.

A low pressure outlet 82 is also formed in igniter body 56. As illustrated in FIG. 2, control valves 84 and 86 are closed, but could be actuated open to fluidly connect the respective closing hydraulic surfaces 96 and 97 to low pressure outlet 82 by way of a drain passage 88 and a drain passage 90, respectively. When control valves 84 and 86, and such other control valves as may be used, are closed, high pressure applied to the respective closing hydraulic surfaces 96 and 97 maintains outlet checks 92 and 93 closed. When control valves 84 and 86 are opened closing hydraulic surfaces 96 and 97 are exposed to low pressure, enabling high fuel pressure supplied by way of nozzle supply passages 80 and 81 to actuate open outlet checks 92 and 93. When control valves 84 and 86 are closed, high pressure again acts on closing hydraulic surfaces 96 and 97 to close the respective outlet checks 92 and 93. This manner of operation will be understood by way of analogy to refer to other outlet checks and control valves in igniter 54. It will also be appreciated that separate direct control of outlet checks enables one, all, or a combination greater than one but less than all of the respective outlet checks to be opened and closed as desired. As will be further apparent from the following description, selective control of the outlet checks can enable igniter 54 to provide a range of fuel injection amounts, or a range of fuel injection properties such as varied spray angle for liquid fuel-only operation, as well as different liquid fuel injection amounts or other varied fuel injection properties for different dual fuel scenarios such as different gaseous fuel substitution ratios.

Spray outlets in outlet sets 76, 77, 78, and 79 define spray axes 102, 103, 104, and 105. Spray axes 102, 103, 104, and 105 may each be offset from spark gap 68 such that fuel spray does not directly impinge upon spark electrodes 66. Spray axes 102, 103, 104, and 105 may be oriented so as to advance outwardly from nozzle 64 in directions that are radially outward and axially downward, relative to igniter center axis 58. "Axially downward" means a direction along igniter center axis 58 that is away from igniter body 56 and toward combustion cylinder 14. Axially upward would be an opposite direction. Radially outward and radially inward are terms used conventionally in connection with igniter center axis 58.

Outlet sets 76, 77, 78, and 79 may vary from one another in at least one of spray outlet number, spray outlet size, or spray angle. In the illustrated embodiment, outlet sets 76, 77, 78, and 79 may have the same spray outlet size and the same spray angle. The present disclosure can exploit the flexibility to design spray outlet sets differently from one another, and in the illustrated embodiment such that outlet sets 76, 77, 78, and 79 have among them at least three different spray outlet numbers. Also in the illustrated embodiment, a number of outlet sets 76, 77, 78, and 79 is four and a number of outlet checks 92, 93, 94, and 95 is also four. In other embodiments three outlet sets and three outlet checks may be used, more than four such as five or six, or potentially two.

Each of the plurality of outlet checks 92, 93, 94, 95 defines an axis of reciprocation located radially outward of igniter center axis 58. In FIG. 2 axes of reciprocation 106 and 107 are shown. Thus, outlet checks 92, 93, 94, and 95 may be circumferentially distributed around igniter center axis 58, with spark electrodes 66 being centrally located such that spark gap 68 is located on or close to igniter center axis 58. Axes of reciprocation 106 and 107, and the other check axes of reciprocation, may be located on a common circle 110 with spark gap 68 located inside common circle 110.

Focusing on FIG. 3, the spray outlets in each respective outlet set 76, 77, 78, and 79 may be biased in distribution outside of common circle 110. Biased in distribution means the respective spray outlets are entirely outside of common circle 110, or a majority of the spray outlets in each respective outlet set 76, 77, 78, and 79 are outside of common circle 110. Example spray plumes 112, 113, 114, and 115 are shown advancing outwardly from outlet sets 76, 77, 78, and 79, respectively. Also in the illustrated embodiment outlet sets 76 and 77 each include a total of one spray outlet, a lesser spray outlet number. Outlet set 79 includes a total of three spray outlets, a greater spray outlet number, and outlet set 78 includes a total of two spray outlets, a medium spray outlet number. It will be recalled that the respective spray outlets could all have the same or similar spray outlet size. Embodiments are also contemplated where a spray outlet number does not vary set-to-set but a spray outlet size does vary. Thus, one outlet set might include two larger spray outlets, another outlet set could include two smaller spray outlets, and another outlet set could include two spray outlets that are smaller still. Those skilled in the art will appreciate a variety of different combinations and implementations that vary spray outlet size, spray outlet number, and potentially also varying spray angle amongst the outlet sets to achieve various aims. In a practical implementation, the plurality of checks in igniter 54 includes at least three outlet checks, and the plurality of outlet sets have among them at least three different spray orifice numbers. The plurality of checks may include four direct-controlled needle checks spaced circumferentially around igniter center axis 58 in a uniformly spaced arrangement. In still other embodiments, check configurations other than a needle check, or potentially check control that is not direct control, or a non-uniform spacing of the checks and outlet sets might be used.

INDUSTRIAL APPLICABILITY

Figure 4:
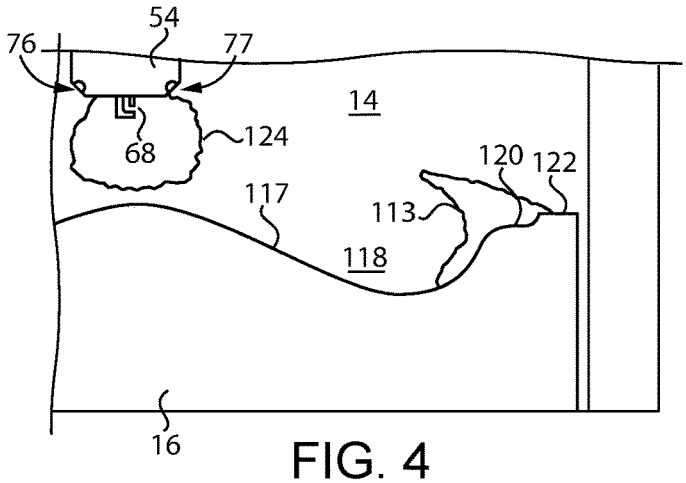
FIG. 4 is a diagrammatic view at one stage of combustion in a dual fuel engine, according to one embodiment.
Figure 5:
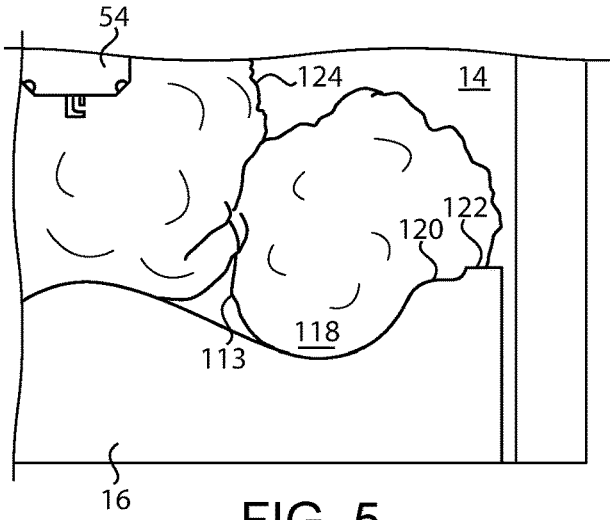
FIG. 5 is a diagrammatic view at another stage of combustion in a dual duel engine, according to one embodiment.

Referring also now to FIGS. 4 and 5, there are shown different states of combustion that might be observed during operating engine system 10. In FIG. 4, piston 16 is shown as it might appear approximately at or just after a TDC position in combustion cylinder 14. It can further be noted piston 16 includes a combustion face 17 forming a combustion bowl 118. Piston 16 also includes a scooped rim portion 120 extending circumferentially around combustion bowl 118, and an outer rim portion 122 positioned radially outward of scooped rim portion. As can also be seen in FIG. 4, a combusting spray plume 113 of a liquid fuel pilot charge has reached, and begun to disperse through and out of, scooped rim portion 120. In a typical application all, but at least some, of spray axes 102, 103, 104, and 105, will be targeted at scooped rim portion 120 when piston 16 is within 30° of the TDC position. Other factors such as fuel pressure, in-cylinder fluid density, engine speed, injection timing, and possibly still other factors can affect the spray plume path trajectories and what part of piston 16 is actually targeted. It will generally be desirable to direct plumes of the pilot liquid fuel injections into scooped rim portion 120. "At least some" means at least one. In the example of FIG. 4 only one spray plume 113 has been injected, from outlet set 77. It will be appreciated that, three-dimensionally, other spray plumes would be observed at other circumferential locations where multiple outlet checks are actuated to inject liquid fuel. Spark electrodes 66 have also been energized to produce an electrical spark at spark gap 68. Thus, in this example, a main charge of gaseous fuel has been conveyed into combustion cylinder 14, and piston 16 has been moved from a BDC position to a TDC position in combustion cylinder 14 to increase a pressure of a mixture of the main charge of gaseous fuel and air in combustion cylinder 14. The increase in pressure is sufficient to autoignite plume 113 as shown. Some, but less than all, of the plurality of checks 92, 93, 94, and 95, and in the illustrated case one, have been lifted and then closed to inject a pilot charge of liquid fuel into combustion cylinder 14.

As shown in FIG. 5, plume 113 has ignited to produce an ignition flame of combusting liquid fuel triggering combustion of gaseous fuel of the main charge. Spark ignition by way of the electrical spark at spark gap 68 has produced an ignition flame 124 that has begun to merge with the flame of plume 113. FIG. 5 depicts what might be observed a few degrees after the TDC position of piston 16 during an expansion stroke. From the state depicted in FIG. 5 piston 16 will continue to move downward as the entirety of the main charge of gaseous fuel rapidly ignites, toward a BDC position.

It will be recalled that engine system 10 can be operated in a dual fuel liquid pilot-ignited mode as well as a liquid fuel-only mode. FIGS. 4 and 5 depict what might be observed in a dual fuel mode, where plume 113 is a very small pilot charge injected early in a compression stroke. In some embodiments, the early pilot injection can occur just shortly after a late intake valve closing timing, such as where piston 16 is at about −60° crank angle. This technique enables a relatively tiny amount of liquid fuel to be injected early and begin to combust relatively slowly to enhance conditions in combustion cylinder 14 for more rapid and complete combustion of the main charge of gaseous fuel. The fuel and air mixture in combustion cylinder 14 may be stoichiometrically lean, and with a gaseous fuel substitution ratio above 90%, potentially above 95%.

Figure 6:
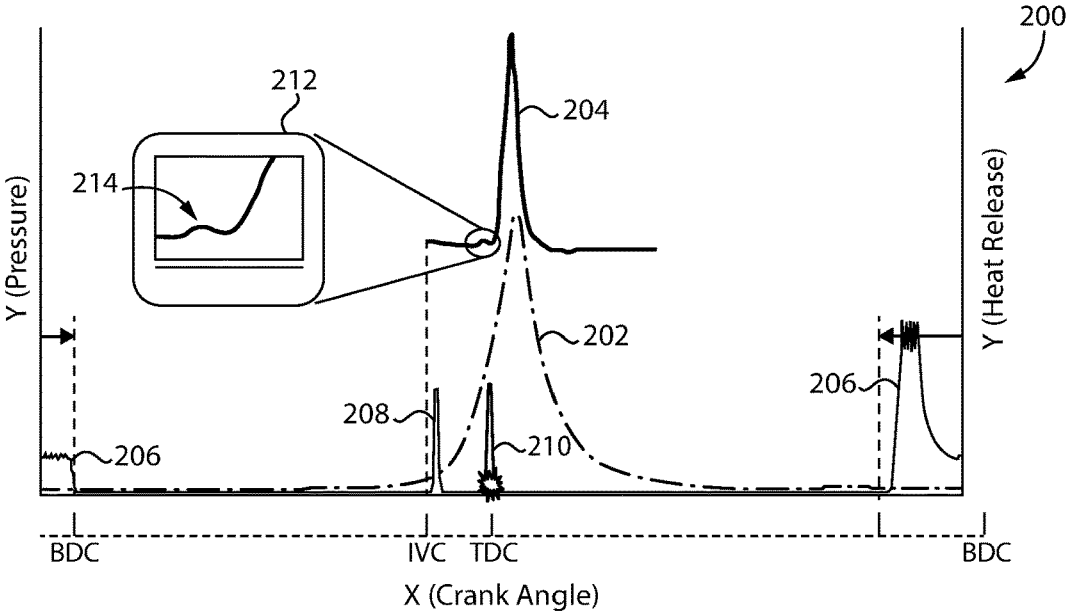
FIG. 6 is a diagram of engine operating events and conditions in a dual fuel engine, according to one embodiment.

Referring now also to FIG. 6, there is shown a diagram 200 where crank angle is shown on the X-axis, cylinder pressure is shown on the left Y-axis, and cylinder heat release is shown on the right Y-axis. A cylinder pressure trace is shown at 202, reaching a peak just after a top-dead-center or TDC crank angle location. Intake valve closing or IVC can be seen just prior to TDC, such as at about −60° crank angle. A main gas delivery is shown at 206 and can be understood to occur during an intake stroke. A liquid fuel pilot injection 208 is shown just after IVC, and production of an electrical spark is shown at 210, occurring typically at or very close to TDC. A heat release curve 204 shows in a detailed enlargement 212 a start of relatively cool and slow combustion 214 occurring just after the pilot injection.

As also noted above, the present disclosure affords considerable flexibility in when, and how much, liquid fuel is delivered for pilot-fueled dual fuel operation or in liquid-fuel only mode. Typically some, but less than all, of the plurality of checks will be lifted in a first engine cycle during a dual fuel mode of operation. At least some and potentially all of the plurality of checks can be lifted in a second engine cycle. In the second engine cycle, which could be operation in a liquid fuel-only mode, another charge of liquid fuel can be injected. Those skilled in the art will appreciate that factors such as engine load can influence optimum fuel injection quantity. In a liquid fuel-only mode 1, 2, 3, or all of the checks might be lifted in a given cycle depending upon engine load, and the number or type (such as 1-orifice, 2-orifice, etc.) of checks used could vary from a first engine cycle to a second engine cycle as load changes.

Factors such as fuel quality in gaseous fuel supplies can also vary over time. In some instances, with gaseous fuel of a higher fuel quality, one or more pilot fuel charges could be injected in a first engine cycle by lifting some but less than all of the plurality of checks in an igniter according to the present disclosure. With lesser fuel quality, one or more pilot fuel charges could be injected in a second engine cycle by lifting some but less than all of the plurality of checks. The one or more checks used to inject a pilot fuel charge in the first engine cycle can be different from the one or more checks used to inject a pilot fuel charge in the second engine cycle. Accordingly, injection of another fuel charge in a second engine cycle could include injection of another pilot charge different, for example, in fuel quantity, timing, spray angle, or other characteristics from a pilot injection in a first engine cycle, to compensate for a change in fuel quality of gaseous fuel. Additional combinations, variations, and permutations will be apparent to those skilled in the art, including in combination with other variations in other engine operating parameters such as intake valve closing timing.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. An igniter for a dual fuel engine comprising:

an igniter body defining an igniter center axis extending between a first igniter body end and a second igniter body end including a nozzle;

the igniter body further having formed therein a fuel inlet, spray outlets formed in the nozzle and arranged in a plurality of outlet sets, and at least one nozzle supply passage extending between the fuel inlet and the spray outlets;

a plurality of outlet checks each movable in the igniter body to open and close the spray outlets in a respective one of the plurality of outlet sets; and spark electrodes mounted to the second igniter body end and forming a spark gap.

2. The igniter of claim 1 wherein the spray outlets define spray axes each offset from the spark gap.

3. The igniter of claim 2 wherein the spray axes are oriented so as to advance outwardly from the nozzle in directions that are radially outward and axially downward relative to the igniter center axis.

4. The igniter of claim 3 wherein the plurality of outlet sets vary in at least one of spray outlet number, spray outlet size, or spray angle.

5. The igniter of claim 4 wherein the plurality of outlet checks includes at least three outlet checks, and the plurality of outlet sets have among them at least three different spray outlet numbers.

6. The igniter of claim 1 wherein each of the plurality of outlet checks defines an axis of reciprocation located radially outward of the igniter center axis.

7. The igniter of claim 6 wherein the axes of reciprocation are on a common circle, and the spark gap is inside the common circle.

8. The igniter of claim 7 wherein the spray outlets in each respective outlet set are biased in distribution outside of the common circle.

9. The igniter of claim 8 wherein the plurality of outlet checks includes four direct-controlled needle checks spaced circumferentially around the igniter center axis.

10. A dual fuel engine system comprising:

an engine housing having a combustion cylinder formed therein;

a piston movable between a bottom-dead-center position and a top-dead-center position in the combustion cylinder; and an igniter including spark electrodes forming a spark gap within the combustion cylinder, a nozzle having spray outlets formed therein and arranged in a plurality of outlet sets, and a plurality of outlet checks each movable to open and close the spray outlets in a respective one of the plurality of outlet sets.

11. The dual fuel engine system of claim 10 wherein the piston includes a combustion face forming a combustion bowl, a scooped rim portion extending circumferentially around the combustion bowl, and an outer rim portion positioned radially outward of the scooped rim portion.

12. The dual fuel engine system of claim 11 further comprising:

a gaseous fuel supply, and a gaseous fuel admission valve positioned fluidly between the gaseous fuel supply and the combustion cylinder; and a liquid fuel supply fluidly connected to the igniter, and each of the plurality of outlet checks is positioned fluidly between the liquid fuel supply and the respective one of the plurality of outlet sets.

13. The dual fuel engine system of claim 11 wherein the spray outlets define spray axes, and at least some of the spray axes are targeted at the scooped rim portion when the piston is within 30° of the top-dead-center position.

14. The dual fuel engine system of claim 10 wherein the plurality of outlet checks includes at least three checks, and the plurality of outlet sets have among them at least three different spray outlet numbers.

15. The dual fuel engine system of claim 14 wherein the plurality of outlet sets have among them two outlet sets with a lesser spray outlet number, an outlet set with a medium spray outlet number, and an outlet set with a greater spray outlet number.

16. The dual fuel engine system of claim 10 wherein the plurality of outlet checks define axes of reciprocation located on a common circle, and the spark gap is inside the common circle.

17. A method of operating a dual fuel engine system comprising:

conveying a main charge of gaseous fuel into a combustion cylinder in an engine housing;

moving a piston from a bottom-dead-center position to a top-dead-center position in the combustion cylinder to increase a pressure of a mixture of the main charge of gaseous fuel and air;

lifting some but less than all of a plurality of checks in an igniter extending into the combustion cylinder;

injecting a pilot charge of liquid fuel into the combustion cylinder from spray outlets in the igniter opened by way of the lifting of some but less than all of a plurality of checks;

producing an electrical spark at a spark gap formed by spark electrodes of the igniter; and combusting the main charge of gaseous fuel based on combustion of the pilot charge of liquid fuel and the electrical spark.

18. The method of claim 17 further comprising merging an ignition flame produced by the combustion of the pilot charge with an ignition flame produced by the electrical spark.

19. The method of claim 17 wherein:

the lifting of some but less than all of the plurality of checks includes lifting one or more of at least three checks in the igniter in a first engine cycle;

the method further comprising:

lifting at least some of the plurality of checks in a second engine cycle; and injecting another charge of liquid fuel into the combustion cylinder from spray outlets in the igniter opened by way of the lifting of at least some of the plurality of checks in a second engine cycle.

20. The method of claim 19 wherein the injecting of another charge includes injecting another pilot charge.

* * * * *